US009897291B2

(12) United States Patent
Clark

(10) Patent No.: US 9,897,291 B2
(45) Date of Patent: Feb. 20, 2018

(54) LIGHT FIXTURE JOINT WITH NOTCHED EDGE AND METHODS INCORPORATING THE SAME

(71) Applicant: HUNTER DOUGLAS INDUSTRIES SWITZERLAND, GMBH, Lucerne (CH)

(72) Inventor: Bruce Clark, Redmond, WA (US)

(73) Assignee: HUNTER DOUGLAS INDUSTRIES SWITZERLAND GMBH, Lucerne (CH)

( * ) Notice: Subject to any disclaimer, the term of this patent is extended or adjusted under 35 U.S.C. 154(b) by 0 days.

(21) Appl. No.: 15/076,852

(22) Filed: Mar. 22, 2016

(65) Prior Publication Data

US 2017/0276327 A1 Sep. 28, 2017

(51) Int. Cl.

| | |
|---|---|
| ***F21V 15/00*** | (2015.01) |
| ***F21V 17/10*** | (2006.01) |
| ***F21S 8/06*** | (2006.01) |
| ***F21V 23/00*** | (2015.01) |
| ***F21V 3/00*** | (2015.01) |

(52) U.S. Cl.

CPC ..... *F21V 17/10* (2013.01); *F21S 8/063* (2013.01); *F21V 3/00* (2013.01); *F21V 17/101* (2013.01); *F21V 23/001* (2013.01)

(58) Field of Classification Search

CPC . F21V 1/12; F21V 1/14; F21V 17/007; F21V 1/26; F21V 17/108; F21V 1/22; F21V 31/005; F21V 7/10

USPC ..... 362/362

See application file for complete search history.

(56) References Cited

U.S. PATENT DOCUMENTS

| | | | |
|---|---|---|---|
| D97,213 | S | 11/1869 | Stone |
| D101,033 | S | 3/1870 | Glatthar et al. |
| D101,034 | S | 3/1870 | Glatthar et al. |

(Continued)

FOREIGN PATENT DOCUMENTS

| | | |
|---|---|---|
| JP | 2003217332 | 7/2003 |
| JP | 2011159472 | 8/2011 |

(Continued)

OTHER PUBLICATIONS

Office Action for U.S. Appl. No. 29/560,681 dated Jun. 15, 2017.

(Continued)

*Primary Examiner* — Thien M Le

(74) *Attorney, Agent, or Firm* — Workman Nydegger

(57) ABSTRACT

Low-profile light fixture joints reduce the appearance of a seam between joined ends of one or more polymeric panels at a connection interface. The joint is formed between a first end of a polymeric panel and a second end of the same or a separate polymeric panel. Each end has an upper edge portion, a lower edge portion opposite the upper edge portion, a flange extending between the upper edge portion and the lower edge portion, and a notch disposed between the flange and one or more of the lower edge portion or the upper edge portion. The notch enables the upper and/or lower edge portions to present straight edges at the connection interface, the joined straight edges forming a butt seam at the connection interface, while the flanges present rounded edges at the connection interface, the joined rounded edges forming a tucked seam at the connection interface.

20 Claims, 10 Drawing Sheets

(56) References Cited

U.S. PATENT DOCUMENTS

| | | | | |
|---|---|---|---|---|
| D136,518 | S | 3/1873 | Hofstetter | |
| D166,671 | S | 8/1875 | Jernigan | |
| D387,459 | S | 8/1888 | Cool | |
| D508,580 | S | 11/1893 | Norris et al. | |
| D525,384 | S | 9/1894 | Waycaster | |
| D525,738 | S | 9/1894 | Waycaster | |
| D541,970 | S | 7/1895 | Blackman | |
| D591,444 | S | 10/1897 | Beno et al. | |
| D592,793 | S | 11/1897 | Chandler | |
| D653,794 | S | 7/1900 | Friedman | |
| D676,587 | S | 6/1901 | Fisher | |
| D676,996 | S | 6/1901 | Gismondi | |
| D684,294 | S | 10/1901 | Goodson | |
| D686,363 | S | 11/1901 | Smith | |
| D697,662 | S | 4/1902 | Patterson | |
| D708,391 | S | 9/1902 | Coury | |
| D716,486 | S | 12/1902 | Martin | |
| D745,206 | S | 11/1903 | Clark | |
| D764,095 | S | 7/1904 | Clark | |
| 1,963,218 | A | 6/1934 | Wakefield | |
| 3,385,963 | A | 5/1968 | Washick | |
| D264,136 | S | 4/1982 | Castiglioni | |
| 4,716,671 | A | 1/1988 | Gross | |
| 4,726,781 | A | 2/1988 | Bernhart | |
| 4,799,526 | A | 1/1989 | Reeves | |
| 5,226,724 | A | 7/1993 | Kanarek | |
| 5,282,600 | A | 2/1994 | Weiss | |
| 5,532,073 | A | 7/1996 | Hirata | |
| 5,532,912 | A * | 7/1996 | Bendit | F21V 1/00 362/352 |
| 5,658,066 | A | 8/1997 | Hirsch | |
| 5,662,412 | A * | 9/1997 | Glendmyer | F21V 1/14 362/351 |
| 5,702,180 | A | 12/1997 | Huang | |
| 5,758,588 | A * | 6/1998 | Orfali | D05C 17/00 112/405 |
| 5,989,015 | A | 11/1999 | Guerin | |
| 6,025,549 | A * | 2/2000 | Harris | G10D 13/02 84/411 R |
| 6,302,566 | B1 | 10/2001 | Cohon | |
| 6,341,880 | B1 | 1/2002 | Hsu | |
| 6,530,674 | B2 | 3/2003 | Grierson | |
| 6,964,507 | B2 | 11/2005 | Mohacsi | |
| 6,984,055 | B2 | 1/2006 | McCarthy | |
| D523,328 | S | 6/2006 | Ramos | |
| D523,771 | S | 6/2006 | Kwan | |
| D536,468 | S | 2/2007 | Crosby | |
| D559,994 | S | 1/2008 | Nagakubo | |
| D566,320 | S | 4/2008 | Kim | |
| 7,380,957 | B2 | 6/2008 | Lanczy | |
| 7,504,159 | B1 | 3/2009 | Suare | |
| D595,888 | S | 7/2009 | Sabemig | |
| D596,452 | S | 7/2009 | Komorski | |
| D600,394 | S | 9/2009 | Ambruster | |
| D603,083 | S | 10/2009 | Trumble | |
| D605,333 | S | 12/2009 | Miranda | |
| 7,766,536 | B2 | 8/2010 | Peifer | |
| D641,520 | S | 7/2011 | Grajcar | |
| D665,525 | S | 8/2012 | Patterson | |
| D666,354 | S | 8/2012 | Bracher | |
| D668,371 | S | 10/2012 | Alpasian | |
| D671,676 | S | 11/2012 | Komarov | |
| D687,589 | S | 8/2013 | Wick | |
| 8,517,845 | B2 | 8/2013 | Shin | |
| D692,391 | S | 10/2013 | Kim | |
| D698,983 | S | 2/2014 | Rampolla | |
| 8,714,775 | B2 | 5/2014 | Bracher | |
| D709,235 | S | 7/2014 | Chu | |
| D728,145 | S | 4/2015 | Shigiang | |
| 9,028,114 | B2 * | 5/2015 | Smith | F21V 21/00 362/147 |
| D760,420 | S | 6/2016 | Tomlinson | |
| D761,991 | S | 7/2016 | Clark | |
| D768,905 | S | 10/2016 | Sonneman | |
| D768,906 | S | 10/2016 | Sonneman | |
| D773,099 | S | 11/2016 | Sonneman | |
| D774,239 | S | 12/2016 | Pardo | |
| D783,197 | S | 4/2017 | Amdt | |
| D786,481 | S | 5/2017 | Wiedemer | |
| 9,644,820 | B2 | 5/2017 | Clark | |
| D791,385 | S | 7/2017 | Sonneman | |
| D791,401 | S | 7/2017 | Sonneman | |
| D792,006 | S | 7/2017 | Sonneman | |
| D792,633 | S | 7/2017 | Sonneman | |
| D797,977 | S | 9/2017 | Farzan | |
| D797,982 | S | 9/2017 | Sonneman | |
| 2001/0046621 | A1 | 11/2001 | Colli | |
| 2002/0071281 | A1 * | 6/2002 | Dickson | F21V 1/00 362/351 |
| 2004/0027830 | A1 | 2/2004 | Chen | |
| 2010/0149791 | A1 | 7/2010 | McCane et al. | |
| 2011/0170294 | A1 | 7/2011 | Mier-Langner | |
| 2012/0081919 | A1 | 4/2012 | Parker | |
| 2013/0094225 | A1 | 4/2013 | Leichner | |
| 2014/0022759 | A1 | 1/2014 | Li | |
| 2014/0153257 | A1 * | 6/2014 | Smith | F21V 21/00 362/355 |
| 2014/0334178 | A1 | 11/2014 | Zharov | |
| 2015/0300605 | A1 | 10/2015 | Clark | |
| 2016/0061429 | A1 * | 3/2016 | Waalkes | A47F 11/10 362/217.15 |
| 2016/0245488 | A1 | 8/2016 | Clark | |
| 2016/0281940 | A1 | 9/2016 | Kim | |
| 2017/0138561 | A1 | 5/2017 | Van Strander | |

FOREIGN PATENT DOCUMENTS

| | | |
|---|---|---|
| KR | 2020100007653 | 7/2010 |
| KR | 2020120007760 | 11/2012 |
| WO | 2013006790 | 1/2013 |
| WO | 2013058961 | 4/2013 |
| WO | 2014081621 | 5/2014 |
| WO | 2015073907 | 5/2015 |
| WO | 2015184156 | 12/2015 |

OTHER PUBLICATIONS

Modern Square LED Chandelier Lighting (available online Sep. 22, 2015) Retrieved from the internet Jun. 2, 2017, retrieved from the internet URL: https://www.amazon.com/VONN-VMC31620AL-Chandelier-Lighting-Adjustable/dp/B015OG45GE/ref=sr__1__2?ie=UTF8&qid=1498172914&sr=8-2&keywords=Modern+Square+LED+Chandelier-+Lighting.

Modern Two-Tier LED Chandelier (available online Sep. 22, 2015) Retrieved from the internet Jun. 2, 2017, retrieved from the internet URL: https://www.amazon.com/VONN-VMC31710SW-Two-Tier-Chandelier-Adjustable/dp/B0150G4J8S/ref=pd__sbs__60__2?__encoding=UTF88,pd__rd__i=130150G4J8S&pd__rd__r=9GZ57EM9VFSJZMQW1ERC&pd__rd__w=XsCRS&pd__rd__wg=VbWDy&psc=1&refRID=9GZ57EM9VFSJZ.

Astro D-Light wall Light (available online) Retrieved from the internet Jun. 2, 2017, retrieved from the intemet URL: https://www.lovelights.co.uk/led-lighting-c17/astro-d-light-led-wall-light-p22295.

Office Action in U.S. Appl. No. 29/560,673 dated May 10, 2017.

Light art (available online Oct. 21, 2013) Retrieved from the internet Mar. 16, 2017, retrieved from the internet URL: www.youtuve.com (search "Lightart.com".

Tin eye reference (available online Oct. 8, 2014) Retrieved from the internet Mar. 23, 2017, retrieved from the internet URL: https://tineye.com/search/cb9bd08581564e1b2247fa8b78t73b92f57cc422/ Reference internet site URL: https://www.architonic.com/en/product/henge-light-ring-medium/1149533.

Ring shade 32 LED Pendant (available online Mar. 28, 2015) Retrieved from the intemet Apr. 8, 2017, retireved from the intemet URL: https://web-beta.archive.org/web/20150328234600/http://www.sonnemanawayoflight.com/ringshade32ledpendant-p-922.html.

(56) References Cited

OTHER PUBLICATIONS

Light In The Box (available online Dec. 30, 2014) Retrieved from the internet Mar. 16, 2017, retrieved from the Internet URL: https://www.amazon.com/LightInTheBox-RingHome-Chandeliers-Lighting-110-120V/dp/B00RL1N79W/ref=pd_bxgy_60_img_3?_encoding=UTF8&pd_rd_i=B00RL1N79W&pd_rd_r=0K15VB464BCF6J7RV59C&pd_rd_w=3rhz3&pd_rd_wg=r7IJv&psc=1&refRID=0K15VB4.
International Search Report & Written Opinion for application No. PCT/US14/65816 dated Feb. 19, 2015.
International Search Report & Written Opinion for application No. PCT/US2015/033014 dated Sep. 8, 2015.
International Search Report & Written Opinion for application No. PCT/US2013/070236 dated Mar. 11, 2014.
Office Action in U.S. Appl. No. 14/767,890 dated May 12, 2017.
Office Action in U.S. Appl. No. 14/646,232 dated Dec. 15, 2016.
Ex Parte Quayle Action for U.S. Appl. No. 29/481,765 dated May 9, 2016.
Ex Parte Quayle Action for U.S. Appl. No. 29/545,539 dated May 23, 2016.
Office Action for U.S. Appl. No. 29/481,765 dated Oct. 16, 2015.
Requirement for Restriction for U.S. Appl. No. 29/530,073 dated May 30, 2017.
Office Action for U.S. Appl. No. 14/646,232 dated May 2, 2016.
Non-Final Office Action for U.S. Appl. No. 29/530,073 dated on Sep. 1, 2017.
Notice of Allowance for U.S. Appl. No. 29/560,673 dated on Nov. 13, 2017.
Non-Final Office Action for U.S. Appl. No. 14/912,396 dated Dec. 29, 2017.
Final Office Action for U.S. Appl. No. 14/767,890 dated Dec. 29, 2017.

* cited by examiner

LIGHT FIXTURE JOINT WITH NOTCHED EDGE AND METHODS INCORPORATING THE SAME

BACKGROUND

1. Technical Field

This disclosure relates to systems, methods, and apparatus for providing illumination.

2. Relevant Art

Recent trends in building design involve using one or more sets of decorative panels to add to the functional and/or aesthetic characteristics of a given structure or design space. In particular, the use of polymeric panels is becoming increasingly popular in lighting applications. Such polymeric materials may be manufactured to be more resilient and to have a similar transparent, translucent, or decorative appearance as cast or laminated glass, but with less cost. In addition, polymer-based materials tend to be more versatile or manipulatable in terms of manufacture and assembly as they can be relatively easily bent, molded, colored, textured, shaped, gauged, cut, and otherwise modified in a variety of different ways and can provide a larger variety of colors, images, interlayers, shapes, and impact resistance than can glass.

Certain polymer-based lighting applications involve the coupling of polymeric sheet material, or panels, to form a lighting structure. The panels can be curved (or rounded), angled, or linear, depending on the design of the lighting structure. Some applications involve coupling multiple smaller polymer-based lighting modules to form a larger modular lighting assembly. Modules and modular assemblies may also be formed of connected polymeric panels. One drawback to such connection systems includes the unsightly gap or seam between two panels or lighting modules at the site of coupling, especially at edges of the lighting fixture, as well as shadows, dark spots, and/or other unsightly byproducts or consequences of the design, manufacturing, and/or assembling process(es). Seams and/or features of this sort may detract from the aesthetic appeal of the lighting element. Furthermore, modular lighting concepts often include connective and other support or mounting hardware that is visible and aesthetically unappealing.

Accordingly, there are a number of limitations and/or disadvantages in polymer-based lighting fixtures that can be addressed.

BRIEF SUMMARY

Implementations of the present disclosure solve one or more of the foregoing or other problems in the art with systems, methods, and apparatus for improving the modularity and/or connectivity of various light fixture sub-components, all the while reducing and/or with reduced visibility of various features, components, and/or connection point(s) therebetween. For example, one or more implementations of the present disclosure include systems, methods, and apparatus for reduced and/or reducing visibility of seams and/or hardware of resin-based lighting fixtures. Certain implementations include connection details that present a straight or linear butt seam at or adjacent to one or more ends or edges of a panel connection interface, and optionally transition into a rounded or curved tucked seam further away or distant from the end(s) or edge(s). Such a configuration can reduce the visibility of the tucked seam from a vantage point that positions the butt seam in front of the tucked seam.

Additional features and advantages of exemplary implementations of the present disclosure will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific implementations thereof, which implementations are illustrated in the appended drawings. Understanding that these drawings depict only typical implementations of the disclosure and are not, therefore, to be considered to be limiting of its scope, the disclosure will be described and explained with additional specificity and detail through the use of the accompanying drawings in which.

DETAILED DESCRIPTION

Figure 1A:
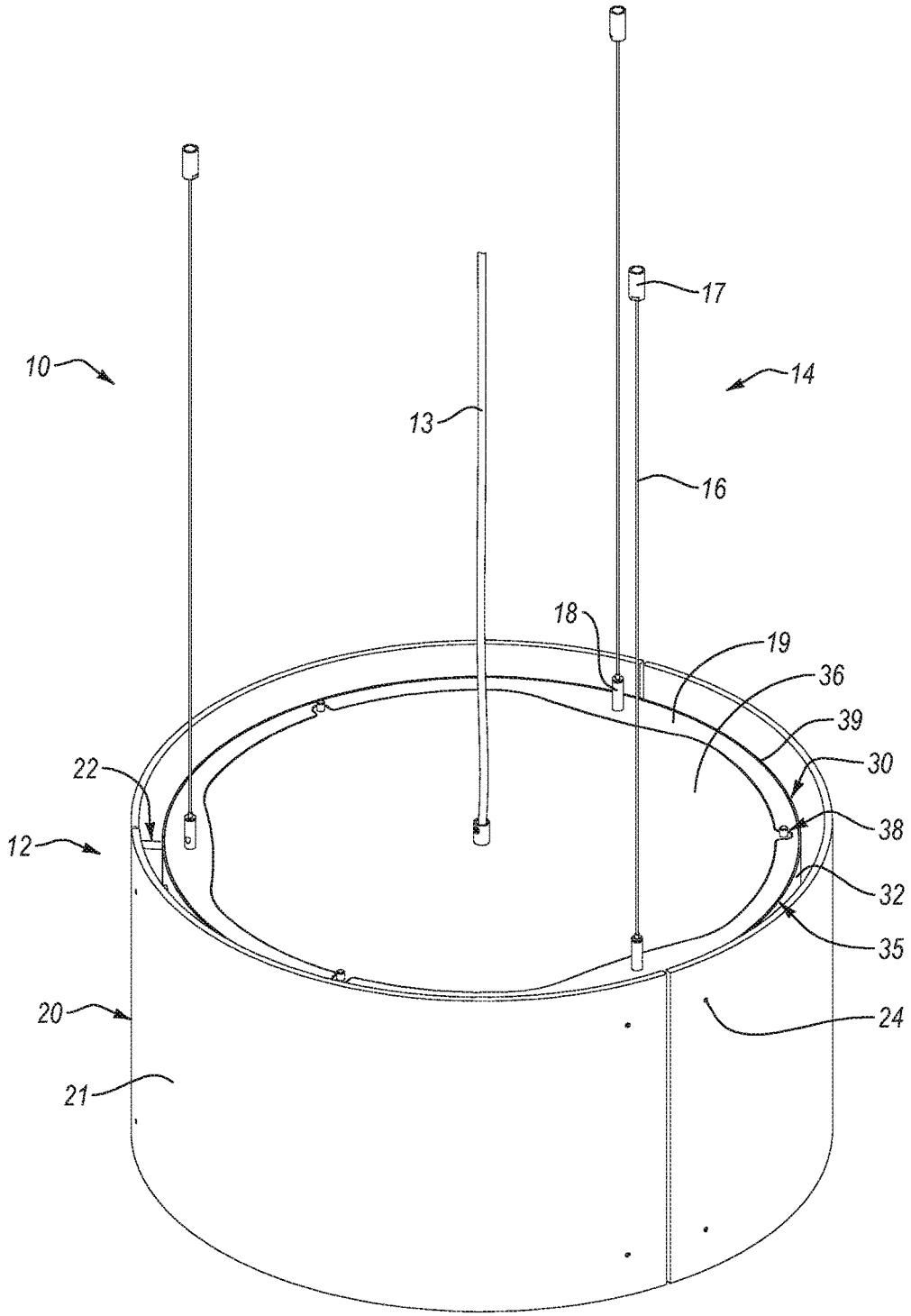
FIG. 1A illustrates a top perspective view of a light fixture assembly in accordance with an implementation of the present disclosure.

Implementations of the present disclosure solve one or more of the foregoing or other problems in the art with systems, methods, and apparatus for improving the modularity and/or connectivity of various light fixture sub-components, all the while reducing and/or with reduced visibility of various features, components, and/or connection point(s) therebetween. For example, one or more implementations of the present disclosure include systems, methods, and apparatus for reduced and/or reducing visibility of seams and/or hardware of resin-based lighting fixtures. Certain implementations include connection details that present a straight or linear butt seam at or adjacent to one or more ends or edges of a panel connection interface, and optionally transition into a rounded or curved tucked seam further away or distant from the end(s) or edge(s). Such a configuration can reduce the visibility of the tucked seam from a vantage point that positions the butt seam in front of the tucked seam.

Before describing the present disclosure in further detail, it is to be understood that this disclosure is not limited to the description of the particularly exemplified systems, methods, and/or products that may vary from one implementation to the next. Thus, while certain implementations of the present disclosure will be described in detail, with reference to specific configurations, parameters, features (e.g., components, members, elements, parts, and/or portions), etc., the descriptions are illustrative and are not to be construed as limiting the scope of the claimed invention. In addition, the terminology used herein is for the purpose of describing the implementations, and is not necessarily intended to limit the scope of the claimed invention.

Unless defined otherwise, all technical and scientific terms used herein have the same meaning as commonly understood by one of ordinary skill in the art to which the present disclosure pertains.

Various aspects of the present disclosure, including systems, processes, and/or products may be illustrated with reference to one or more implementations or embodiments, which are exemplary in nature. As used herein, the terms "embodiment" and "implementation" mean serving as an example, instance, or illustration, and should not necessarily be construed as preferred or advantageous over other aspects disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

As used herein, the term "systems" also contemplates devices, apparatus, compositions, assemblies, kits, and so forth. Similarly, the term "method" also contemplates processes, procedures, steps, and so forth. Moreover, the term "products" also contemplates devices, apparatus, compositions, assemblies, kits, and so forth.

As used throughout this application the words "can" and "may" are used in a permissive sense (i.e., meaning having the potential to), rather than the mandatory sense (i.e., meaning must). Additionally, the terms "including," "having," "involving," "containing," "characterized by," as well as variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

It will be noted that, as used in this specification and the appended claims, the singular forms "a," "an" and "the" include plural referents unless the context clearly dictates otherwise. Thus, for example, reference to a "seam" includes one, two, or more seams. Similarly, reference to a plurality of referents should be interpreted as comprising a single referent and/or a plurality of referents unless the content and/or context clearly dictate otherwise. Thus, reference to "seams" does not necessarily require a plurality of such seams. Instead, it will be appreciated that independent of conjugation; one or more seams are contemplated herein.

As used herein, directional, positional, and/or orientational terms, such as "top," "bottom," "left," "right," "up," "down," "upper," "lower," "inner," "outer," "internal," "external," "interior," "exterior," "proximal," "distal" and so forth can be used arbitrarily and/or solely to indicate relative directions, positions, and/or orientations and may not be otherwise intended to limit the scope of the disclosure, including the specification, drawings, and/or claims.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated.

To facilitate understanding, like references (i.e., like naming of components and/or elements) have been used, where possible, to designate like elements common to the figures. Specifically, in the exemplary implementations illustrated in the figures, like structures, or structures with like functions, will be provided with similar reference designations, where possible. Specific language will be used herein to describe the exemplary implementations. Nevertheless it will be understood that no limitation of the scope of the disclosure is thereby intended. Rather, it is to be understood that the language used to describe the exemplary implementations is illustrative only and is not to be construed as limiting the scope of the disclosure (unless such language is expressly described herein as essential).

It will also be appreciated that where multiple possibilities of values or a range of values (e.g., less than, greater than, at least, and/or up to a certain value, and/or between two recited values) is disclosed or recited, any specific value or range of values falling within the disclosed range of values is likewise disclosed and contemplated herein. Thus, disclosure of an illustrative measurement or amount less than or equal to about 10 units or between 0 and 10 units includes, illustratively, a specific disclosure of: (i) a measurement or amount of 9 units, 5 units, 1 units, or any other value between 0 and 10 units, including 0 units and/or 10 units; and/or (ii) a measurement or amount between 9 units and 1 units, between 8 units and 2 units, between 6 units and 4 units, and/or any other range of values between 0 and 10 units.

The headings used herein are for organizational purposes only and are not meant to be used to limit the scope of the description or the claims.

Low-profile light fixture joints can reduce the appearance of a seam between joined ends of one or more polymeric panels at a connection interface. The joint can be formed between a first end of a polymeric panel and a second end of the same or a separate polymeric panel. The first and second ends can each have an upper edge portion, a lower edge portion opposite the upper edge portion, a flange extending between the upper edge portion and the lower edge portion, and a notch disposed between the flange and one or more of the lower edge portion or the upper edge portion.

The notch can enable the flange to be bent relative to the upper and/or lower edge portions, such that the flange presents a rounded edge at the connection interface, and such that the joined rounded edges form a tucked seam at the connection interface, while the upper and/or lower edge portions remain substantially straight (e.g., unbent, unrounded, uncurved, etc.), such that the upper and/or lower edge portions present a straight edge at the connection interface, and such that the joined straight edges form a butt seam at the connection interface.

Accordingly, the joint can comprise a linear or straight adjoining butt seam at or adjacent to the lower and/or upper edges of a panel connection interface, that transitions into a rounded or curved tucked seam further away or distant from the lower and/or upper edges. Thus, hanging or suspended light fixtures incorporating such joint(s) can display a tight-fitting, straight edged, butt seam from directly below the connection interface. Similarly, floor or structure mounted light fixtures incorporating such joint(s) can display a tight-fitting, straight edged, butt seam from directly above the connection interface. The butt seam(s) can reduce the visibility of the tucked seam from above and/or below the light fixture (e.g., when the butt seam is disposed in front of the tucked seam).

As used herein, the terms "polymeric panel," "polymer material," and the like refer to a panel, film, sheet, or other element comprising a substrate of one or more layers formed from one or more thermoplastic polymers (or alloys thereof). Specifically, such materials can include, but are not limited to, polyethylene terephthalate (PET), polyethylene terephthalate with glycol-modification (PETG), acrylonitrile butadiene-styrene (ABS), polyvinyl chloride (PVC), polyvinyl butyral (PVB), ethylene vinyl acetate (EVA), polycarbonate (PC), styrene, polymethyl methacrylate (PMMA), polyolefins (low and high density polyethylene, polypropylene), thermoplastic polyurethane (TPU), cellulose-based polymers (cellulose acetate, cellulose butyrate or cellulose propionate), acrylics, or the like.

As used herein, the term "connection interface" and similar terms refer to a point, area, or plane at which (the surface of) one component is connected (e.g., brought together, joined, etc.) with (the surface of) another component. Such components can include separate pieces or separate portions of the same piece.

As used herein, the terms "butt seam," "straight seam," and the like refer to the distinction or gap between to edges or surfaces that terminate in a joinder at a connection interface. Such seams, when formed tightly, often have the appearance of a fine line between the two edges or surfaces.

Certain implementations of the present disclosure include a low-profile light fixture joint comprising a first end of a polymeric panel joined with a second end of the same or a separate polymeric panel at a connection interface. The first end and the second end each comprise an upper edge portion (e.g., adjacent to a top edge of the panel), a lower edge portion opposite the upper edge portion (e.g., adjacent to a bottom edge of the panel), and a flange extending between the upper edge portion and the lower edge portion. The flange of the first end can be secured to the flange of the second end with one or more fasteners, such as an adhesive or attachment hardware. Alternatively, the flanges can be bent so as to produce opposing forces on adjacent panels, such that the opposing forces of a first joint stabilize and/or secure a second (opposing) joint, and vice versa.

The lower edge portion of the first end and the lower edge portion of the second end each present a substantially straight edge at the connection interface. In particular, polymeric panels comprise a sheet material having a front surface and an opposing back surface. The respective lower edge portions can each have a substantially straight, linear, or blunt edge extending between the front and back surfaces. The straight edge of the lower edge portion of the first end contacts the straight edge of the lower edge portion of the second end to form a butt seam at the connection interface.

The flange of the first end and the flange of the second end, on the other hand, each present a rounded edge at the connection interface. For instance, a flange can extend from a panel (e.g., from a middle edge disposed between the upper and lower edge portions) beyond the terminal end of the edge portions. Accordingly, for the respective upper edge portions to be joined in at the connection interface so as to form a butt seam, the flanges may need to be moved (e.g., bent) so as to present or form a rounded corner that is substantially aligned with the blunt, terminal end of the edge portions. The rounded corner (or edge) of the flange of the first end and the rounded corner (or edge) of the flange of the second end form a tucked seam at the connection interface (like the inseam of a pant).

In certain implementations, the flange can be bent to an angle (e.g., (slightly) less than 90°) relative to the edge portions or (e.g., (slightly) more than 90°) relative to the inner surface of the panel. Accordingly, in a multi-panel configuration, the joined flanges can produce opposing forces that, when translated along the length of the panels, presses an opposing joint together at an opposing interface. The force can be sufficient to produce a tight seam between the opposing edge portions, such that the butt seam is substantially devoid of a perceivable gap between the blunt, terminal end of the edge portions.

Some implementations further include a notch disposed or formed between the flange and at least the lower edge portion of each panel. The notch can comprise a cut, a nick, or a break between the flange and the lower (and/or upper) edge portion of the respective panels. The notch can be sized so as to be substantially invisible or unperceivable from the side opposite the tucked flanges. In certain implementations, the notch relieves tension, stress, or other force between the bent flange and the substantially straight edge portion(s). For instance, the notch can enable the lower and/or upper edge portion to retain the respective straight edges (or butt seam) at the connection interface while the respective flanges present the respective rounded edges (or tucked seam) at the connection interface.

The flange(s) can also have a tapered or recessed top edge and/or a tapered or recessed bottom edge extending away from the notch and/or corresponding edge portion at a suitable angle (e.g., 45°). The tapered or recessed edge(s) or angle thereof can be structurally adapted or configured to reduce or substantially prevent shadowing on portion(s) of the polymeric panel(s) (e.g., upper and/or lower edge portion(s)) or other light fixture component(s), while maintaining sufficient flange material at the tapered or recessed edge portion to provide structural stability.

The first end and the second end can be opposing ends of the same panel or respective ends of separate panels, depending upon the specific implementation. The joint can be incorporated into a light fixture comprised of a drum having an encircling sidewall comprising one or more polymeric panels. First and second ends of the encircling sidewall can be joined together at a connection interface that includes the low-profile joint. In addition, a method of forming a low-profile light fixture joint can include joining the first and second ends of the encircling sidewall (i.e., of one or more polymeric panels) at the connection interface. The method can also include securing the flange of the first end and the flange of the second end together by means of one or more fasteners and/or forming the first and/or second end by bending the flange thereof relative to the lower and/or upper edge portion thereof while maintaining the lower and/or upper edge portion in a substantially unbent (or less bent) configuration.

Figure 1B:
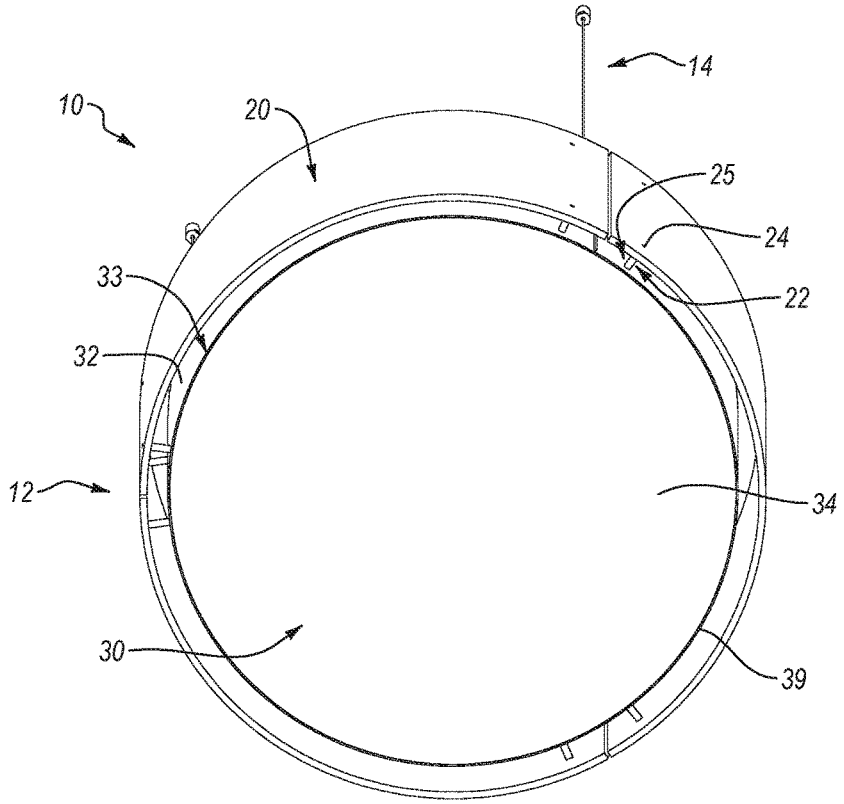
FIG. 1B illustrates a bottom perspective view of the light fixture assembly of FIG. 1A.

Turning now to the figures, FIGS. 1A-1B illustrate, respectively, top and bottom perspective views of a light fixture assembly 10 accordingly to an implementation of the present disclosure. Light fixture assembly 10 comprises a light fixture 12, an optional mounting mechanism 14 connected to light fixture 12, and an optional power cord 13 extending from light fixture 12.

As illustrated in the depicted embodiment, light fixture 12 comprises an outer display element 20 and an inner drum 30 to which outer display element 20 is connected by means of one or more connection components 22. In the depicted embodiment, both display element 20 and drum 30 have rounded and/or circular configurations. It will be appreciated, however, that display element 20 and/or drum 30 can also have oval, rectangular, square, or any other geometric, curves, or other shape or configuration.

Display element 20 can comprise one or more panels 21 formed of a polymeric or other material. The panels 21 can have a sheet configuration and can be opaque or non-opaque (i.e., translucent or transparent). Connection components 22 can connect display element 20 to drum 30 by any suitable mechanism. For instance, connection components 22 can comprise fasteners, such as mounting hardware (e.g., screws, bolts, nuts, anchors, rivets, etc.) and/or adhesives (glue, epoxy, tape, etc.). In the depicted embodiment, a connection component 22 comprises mounting hardware that extends into an opening 24 in display element 20 and a corresponding opening 25 in drum 30 (or sidewall 32 thereof). Alternatively, panel 21 can be thermoformed, pressure fit, or otherwise connected to drum 30. In at least one implementation, panel 21 can be independently suspended about drum 30 (e.g., without being connected thereto).

Inner drum 30 comprises an encircling sidewall 32, an optional lower diffuser 34 connected to (e.g., secured within) a lower edge 33 of sidewall 32, and an optional upper diffuser 19 connected to (e.g., secured within) an upper edge 35 of sidewall 32. In some implementations, lower diffuser 34 and/or upper diffuser 19 can be comprised of polymeric material, such as an acrylic. Lower diffuser 34 and/or upper diffuser 19 can be connected to (e.g., secured within) sidewall 32 by means of one or more fasteners 39, such as an adhesive, or can be thermoformed thereto. The fastener can also secure sidewall 32 in a circular or other configuration (e.g., without additional fastening hardware or adhesives. Alternatively, sidewall 32 can be wrapped around lower diffuser 34 and/or upper diffuser 19, such that lower diffuser 34 and/or upper diffuser 19 are retained by sidewall 32 by means of friction and/or a pressure fit.

As further illustrated in the depicted embodiment, light fixture 12 can be configured for suspension from a ceiling or other structure in certain implementations by means of mounting mechanism 14. Mounting mechanism 14 includes a plurality of mounting cables 16 having support structure fasteners 17 disposed at one end thereof and light fixture fasteners 18 disposed at the opposite end thereof. Fasteners 18 are attached to upper diffuser 19, which is connected and/or secured to drum 30 and/or sidewall 32, or portion thereof. Upper diffuser 19 can also be secured to a lid 36 by means of one or more fasteners 38 (e.g., extending through aligned openings in each of lid 36 and upper diffuser 19). Alternatively, fasteners 18 can be secured directly to a portion of drum 30, lid 36 upper diffuser 19, and/or sidewall 32.

In certain implementations, lid 36 can comprise a lighting lid. For instance, lid 36 can be comprised of powder-coated aluminum or other suitable material and can have one or more lighting elements (not shown) connected to the under surface thereof. Power cord 13 can supply electrical power to the lighting elements to illuminate light fixture 12 (or drum 30 thereof) and/or assembly 10. Such lighting elements can comprise incandescent bulbs, LED, or any other suitable means for providing illumination.

Those skilled in the art will appreciate, however, that the present disclosure is not limited to suspended light fixtures. Rather, certain implementations of the present disclosure can include wall-, floor-, pillar-, or other structure-mounted and/or free-standing light fixtures. Accordingly, alternative mounting mechanisms can connect light fixture 12 to any suitable support structure.

Figure 1C:
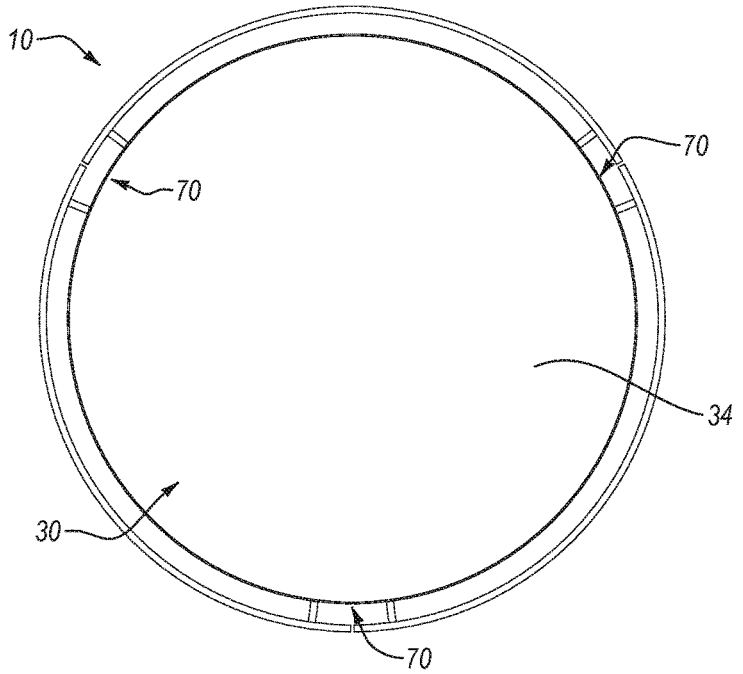
FIG. 1C illustrates a bottom plan view of the light fixture assembly of FIG. 1A.

As discussed in further detail below, FIG. 1C illustrates a bottom plan view of light fixture assembly 10.

Figure 2A:
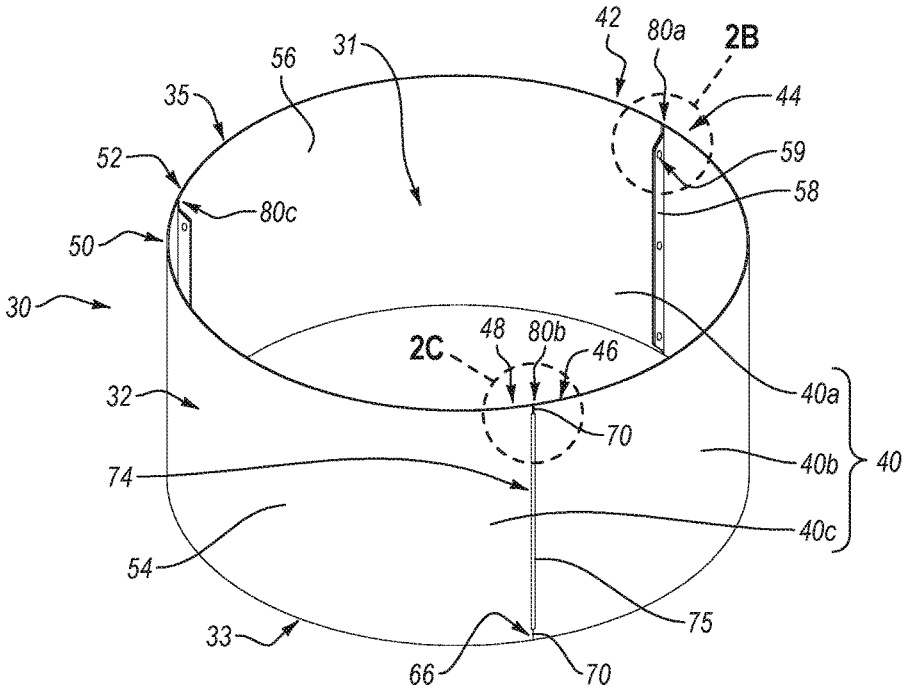
FIG. 2A illustrates a top perspective view of a drum useful in forming a light fixture assembly in accordance with another implementation of the present disclosure.

FIG. 2A illustrates a drum 30 comprising encircling sidewall 32, which bounds an interior space 31. Encircling sidewall 32 comprises and/or is formed of a plurality of panels 40. Specifically, encircling sidewall 32 comprises a first panel 40*a*, a second panel 40*b*, and a third panel 40*c* connected one to another (in a substantially circular configuration) at a plurality of connection interfaces 80. For instance, a first end 42 of panel 40*a* can be connected to a second end 44 of panel 40*b* at a first connection interfaces 80*a*, a first end 46 of panel 40*b* connected to a second end 48 of panel 40*c* at a second connection interfaces 80*b*, and a first end 50 of panel 40*c* connected to a second end 52 of panel 40*a* at a third connection interfaces 80*c*.

Each panel 40 has a curved configuration between the respective first and second ends thereof, with each panel 40 providing 120° of curvature in the circular sidewall 32. Those skilled in the art will appreciate, however, that encircling sidewall 32 can have other, non-circular configurations without departing from the scope of the present disclosure. In addition, encircling sidewall 32 can be comprised of other than three panels 40. For instance, in an alternative implementation, encircling side wall 30 can comprise a single panel 40, with a curved configuration, such that a first end thereof is disposed adjacent, attached, and/or attachable to an opposing second end thereof (e.g., panel 40 providing 360° of curvature in the circular sidewall 32). Similarly, encircling side wall 32 can comprise two panels 40, each panel 40 providing 180° of curvature in the circular sidewall 32, four panels 40, each panel 40 providing 90° of curvature in the circular sidewall 32, and so forth. Indeed, panels 40 can provide any suitable range or degree of curvature between 1° and 360°.

In an alternative implementation, a first panel 40 can provide a first range or degree of curvature and a second panel 40 can provide a second range or degree of curvature. For instance, encircling side wall 32 can comprise four panels 40, wherein two of the panels 40 provide 120° of curvature and two of the panels 40 provide 60° of curvature in the encircling sidewall 32. Accordingly, any suitable combination of panels 40 can be provided to form encircling side wall 32.

Each panel 40 also has an outer surface 54 and an inner surface 56 opposite outer surface 54, each surface extending between the respective first and second ends of the panel 40. The respective inner surfaces 56 of panels 40 form an inner surface 56 of sidewall 32 and the respective outer surfaces 54 of panels 40 form an outer surface 54 of sidewall 32. In at least one implementation, panels 40 can comprise or be formed of PETG or other suitable polymeric material.

Figure 2B:
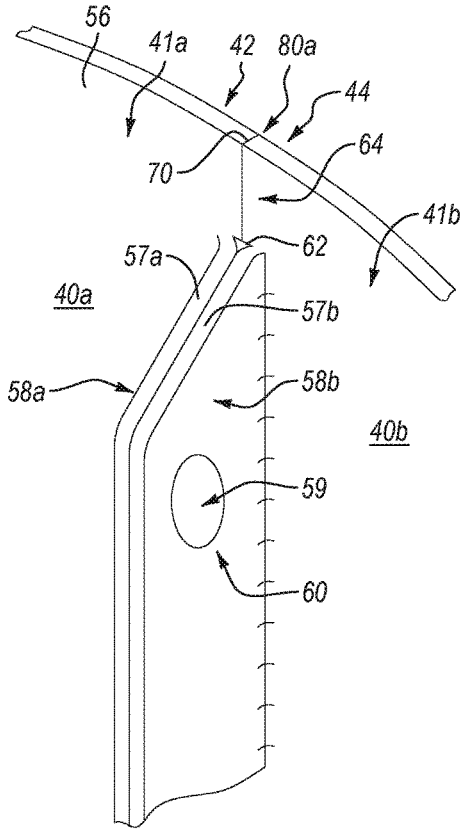
FIG. 2B illustrates a detailed view of a portion of the drum of FIG. 2A.

As depicted further in the detailed view illustrated in FIG. 2B, each panel 40 includes a body portion 41 and a flange 58 extending from the first end and from the second end thereof. As illustrated in the depicted embodiment, the flanges 58 project into the interior space 31 of drum 30 (e.g., within the bounds of inner surface 56). A first flange 58*a* of panel 40*a* (extending from body portion 41*a* thereof) is joined with a second flange 58*b* of panel 40*b* (extending from body portion 41*a* thereof) by means of one or more fasteners 59. As depicted in FIG. 2B, fastener 59 can comprise an attachment hardware extending through opposing openings 60 disposed in the flanges 58*a* and 58*b*, respectively. In at least one implementation, however, fasteners 59 can be removed from openings 60 disposed in the flanges 58*a* and 58*b*, respectively, following at least partial assembly of light fixture 12 and/or assembly 10. Without being bound to any theory, such fastening hardware can produce undesirable shadowing effects on portions of lighting element 12 and/or assembly 10 (e.g., in an illuminated state) and/or add undesirable weight to drum 30. In an alternative embodiment, however, fastener 59 can comprise an adhesive disposed between and/or securing flanges 58*a* and 58*b*.

As discussed in further detail below, panels 40 can also include a notch 62 disposed between flange 58 and an upper edge portion 64 of panel 40. A similar notch 62 can also be disposed between flange 58 and a lower edge portion 66 of panel 40. In at least one implementation, upper edge portion 64 and lower edge portion 66 of panel 40 can have a substantially identical (e.g., mirror image) configurations, with a substantially identical notch 62 disposed between flange 58 and each of the upper edge portion 64 and lower edge portion 66. In an alternative embodiment, however, a notch 62 can be disposed between lower edge portion 66 and flange 58, without a similar notch 62 disposed between upper edge portion 64 and flange 58, or vice versa.

Flange 58 can also have a tapered or recessed top and/or bottom edge 57 (e.g., extending at an angle away from upper edge 35 and/or lower edge 33 of sidewall 32 and/or panel 40 thereof, upper edge portion 64 and/or lower edge portion 66 of panel 40, and/or notch(es) 62). For instance, as depicted in FIG. 2B, flange 58*a* has a tapered or recessed top edge 57*a* and flange 58*b* has a tapered or recessed top edge 57*b*, each extending (diagonally) away from notch 62 and/or upper edge 35 at an angle (e.g., about 45°). It will be appreciated, however, that other angles of recess are also contemplated herein. In an alternative embodiment, top edge 57 may not be recessed. Instead, top edge 57 can extend (perpendicularly) away from notch 62 at a 90° angle. Alternatively, top edge 57 can extend towards upper edge 35 at an angle (e.g., between 1° and 90°). It will also be appreciated that flange 58 can have a lower edge 57 configured similar to or different than upper edge 57.

In certain implementations, tapered or recessed edge(s) (or (45°) angle thereof) can be structurally adapted or configured to reduce or substantially prevent shadowing on portion(s) of the polymeric panel(s) (e.g., upper and/or lower edge portion(s)) or other light fixture component(s) (e.g., upper diffuser 19 and/or lower diffuser 34 (see FIGS. 1A-1C)), while maintaining sufficient flange material at the tapered or recessed edge portion to provide structural stability.

Figure 2C:
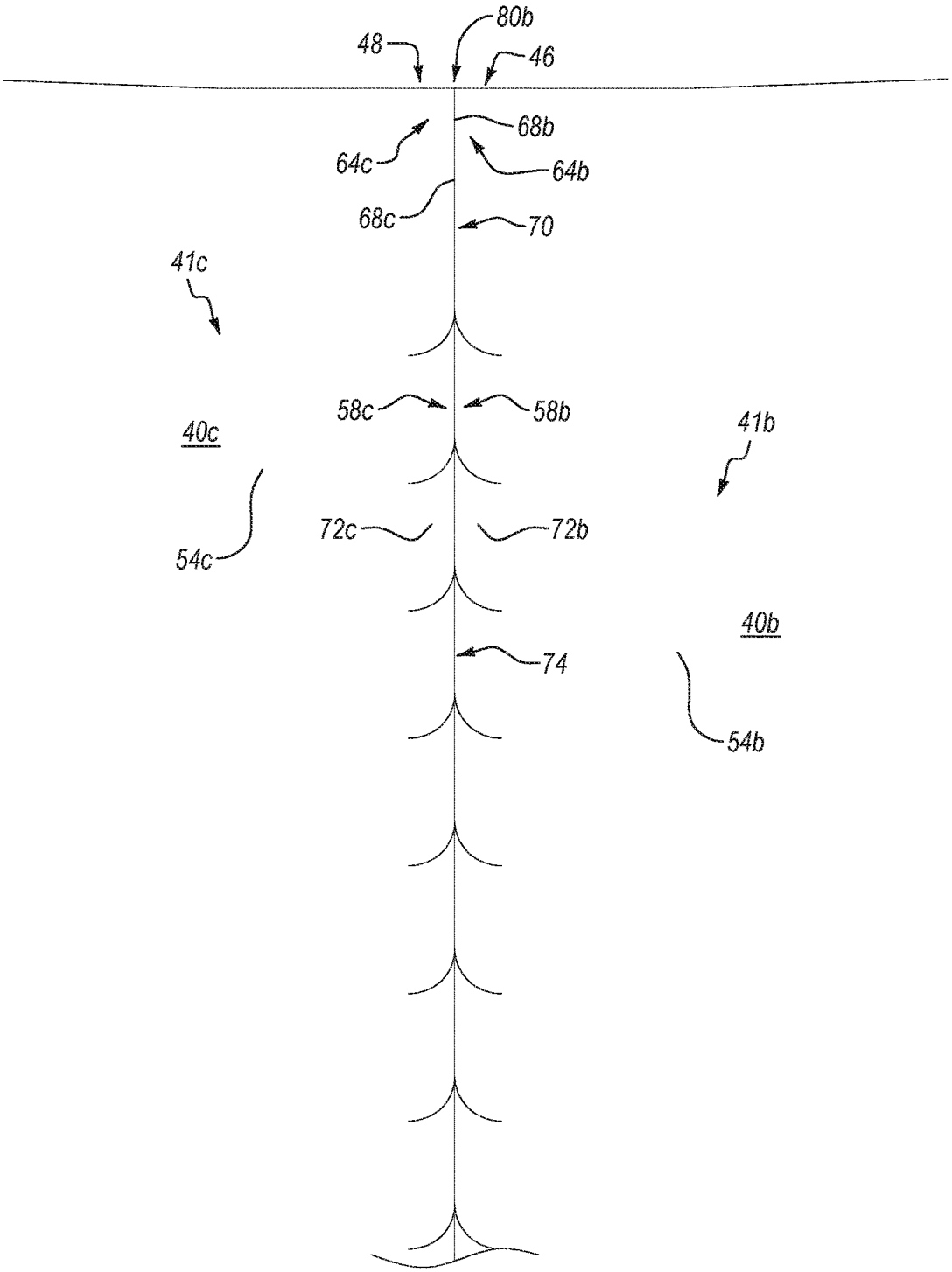
FIG. 2C illustrates a front elevation view of another portion of the drum of FIG. 2A.
Figure 2D:
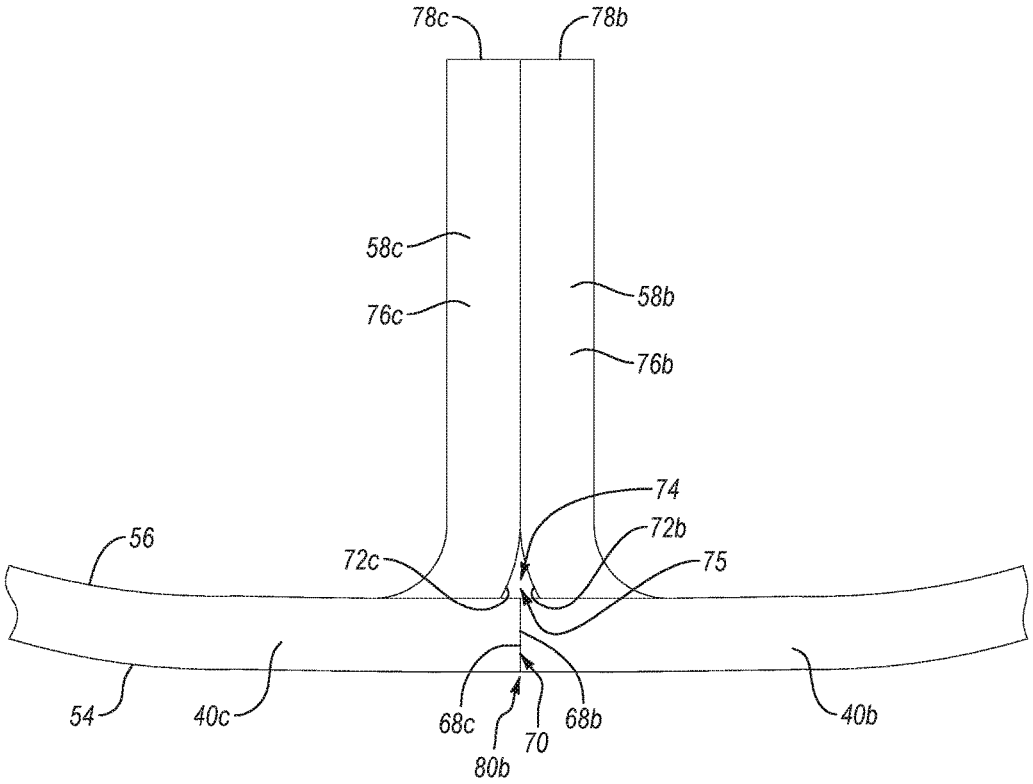
FIG. 2D illustrates a top plan view of the portion illustrated in FIG. 2C.

Turning now to FIGS. 2C and 2D, and with continued reference to FIGS. 2A and 2B, lower edge portion 66 and/or upper edge portion 64 can each present a straight edge 68 at connection interface 80. For instance, as depicted in the enlarged facing view illustrated in FIG. 2C, upper edge portion 64*b* of first end 46 of panel 40*b* can have and/or present a straight edge 68*b* at connection interface 80*b* and upper edge portion 64*c* of second end 48 of panel 40*c* can have and/or present a straight edge 68*c* at connection interface 80*b*. Straight edge 68*b* and straight edge 68*c* can be joined together so as to form a butt seam 70 at connection interface 80*b*. It is noted that lower edge portions 66 can be configured similar and or substantially identical to upper edge portion 64.

Flange 58*b* of first end 46 of panel 40*b* can have and/or present a rounded edge 72*b* at connection interface 80*b* and flange 58*c* of second end 48 of panel 40*c* can have and/or present a rounded edge 72*c* at connection interface 80*b*. Rounded edge 72*b* and rounded edge 72*c* can be joined together so as to form a tucked seam 74 at connection interface 80*b*. Tucked seam 74 can present a surface gap (or indent) 75 in exterior surface 54 (e.g., between exterior surface 54 of panel 40*b* (or body portion 41*b* thereof) and exterior surface 54 of panel 40*c* (or boy portion 41*b* thereof)). Behind tucked seam 74 (e.g., adjacent inner surface 56), a body portion 76*b* of flange 58*b* can be joined with a body portion 76*c* of flange 58*c*. In at least some implementations, flanges 58*b* and 58*c* can extend, respectively, away from inner surface 56, upper edge portions 68*b* and 68*c*, rounded edges 72*b* and 72*c*, and/or interface 80*b*, such that a (terminal) end 78*b* of flange 58*b* and/or a (terminal) end 78*c* of flange 58*c* is disposed within interior space 31 (e.g., opposite exterior surface 54).

In at least some implementations, notch 62 can be sized so as to be substantially invisible or unperceivable from exterior surface 54 (opposite tucked flanges 58). For instance, notch 62 can be or extend less than about 10 mm, 9 mm, 8 mm, 7 mm, 6 mm, 5 mm, 4 mm, 3 mm, 2 mm, or 1 mm (e.g., between flange 58 and edge portion 64, 66. In other implementations, notch 62 can be or extend less than about 5%, 4%, 3%, 2%, 1%, 0.5%, or 0.25% the width of flange 58 (or the distance flange 58 extends away from edge 68).

Moreover, as depicted best in FIG. 2D, respective body portions 76*c* and 76*b* of flanges 58*c* and 58*b* can be joined and aligned with seam 70 at connection interface 80*b*. Stated another way, the interface between respective body portions 76*c* and 76*b* of flanges 58*c* and 58*b* and respective edges 68*c* and 68*b* (or the surface thereof) of panels 40*c* and 40*b* can be substantially parallel and/or aligned (e.g., in the same (vertical) plane). Thus, the angle between respective body portions 76*c* and 76*b* of flanges 58*c* and 58*b*, and respective upper edge portions 64*c* and 64*b* of panels 40*c* and 40*b* can be about 90° in the assembled drum 30. However, as discussed in further detail below, prior to assembly of drum 30, the angle between respective body portions 76*c* and 76*b* of flanges 58*c* and 58*b* and respective upper edge portions 64*c* and 64*b* of panels 40*c* and 40*b* can be at least slightly less than 90°. Similarly, prior to assembly of drum 30, the angle between respective body portions 76*c* and 76*b* of flanges 58*c* and 58*b* and respective inner surfaces 56 of panel 40 can be at least slightly greater than 90°.

Figure 3A:
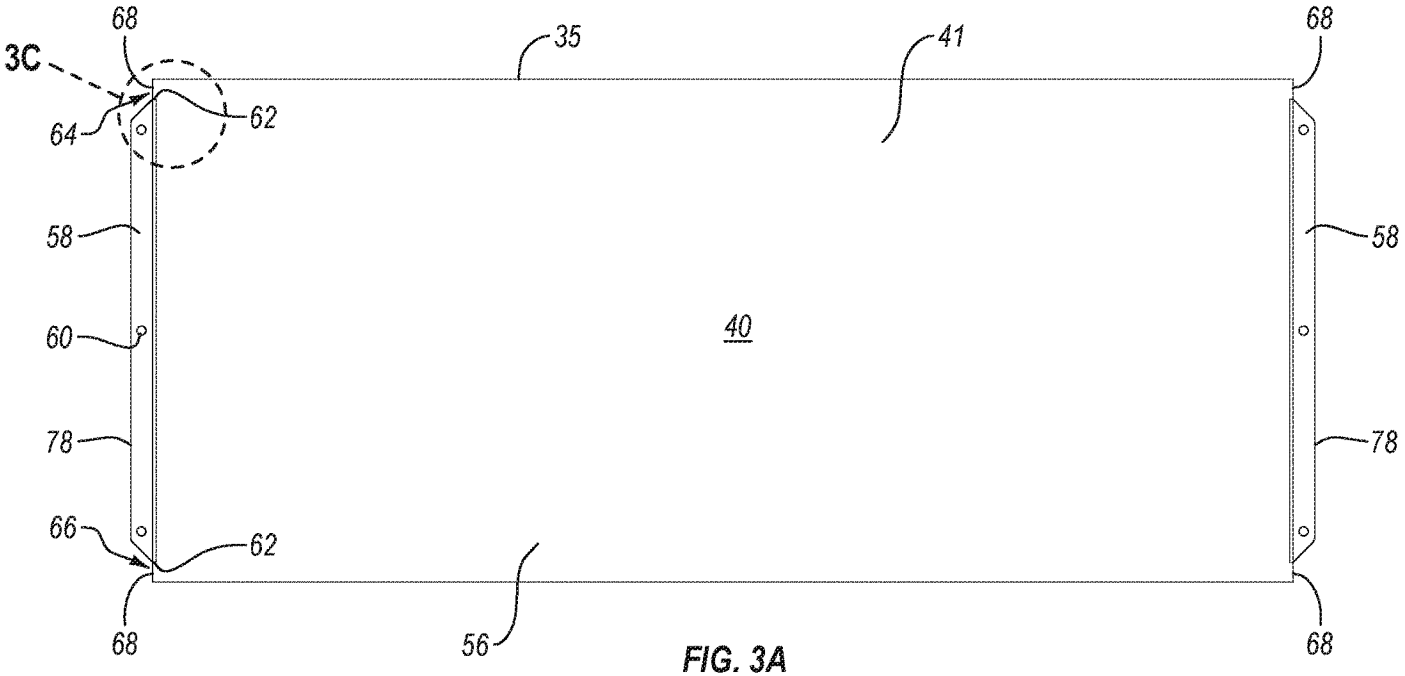
FIG. 3A illustrates a rear elevation view of a panel useful in forming a drum in accordance with another implementation of the present disclosure.
Figure 3B:
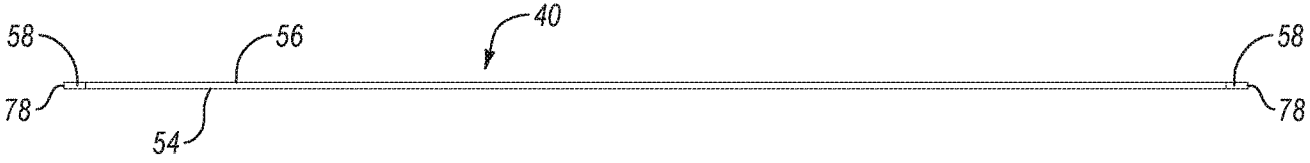
FIG. 3B illustrates a bottom plan view of the panel of FIG. 3A.
Figure 3C:
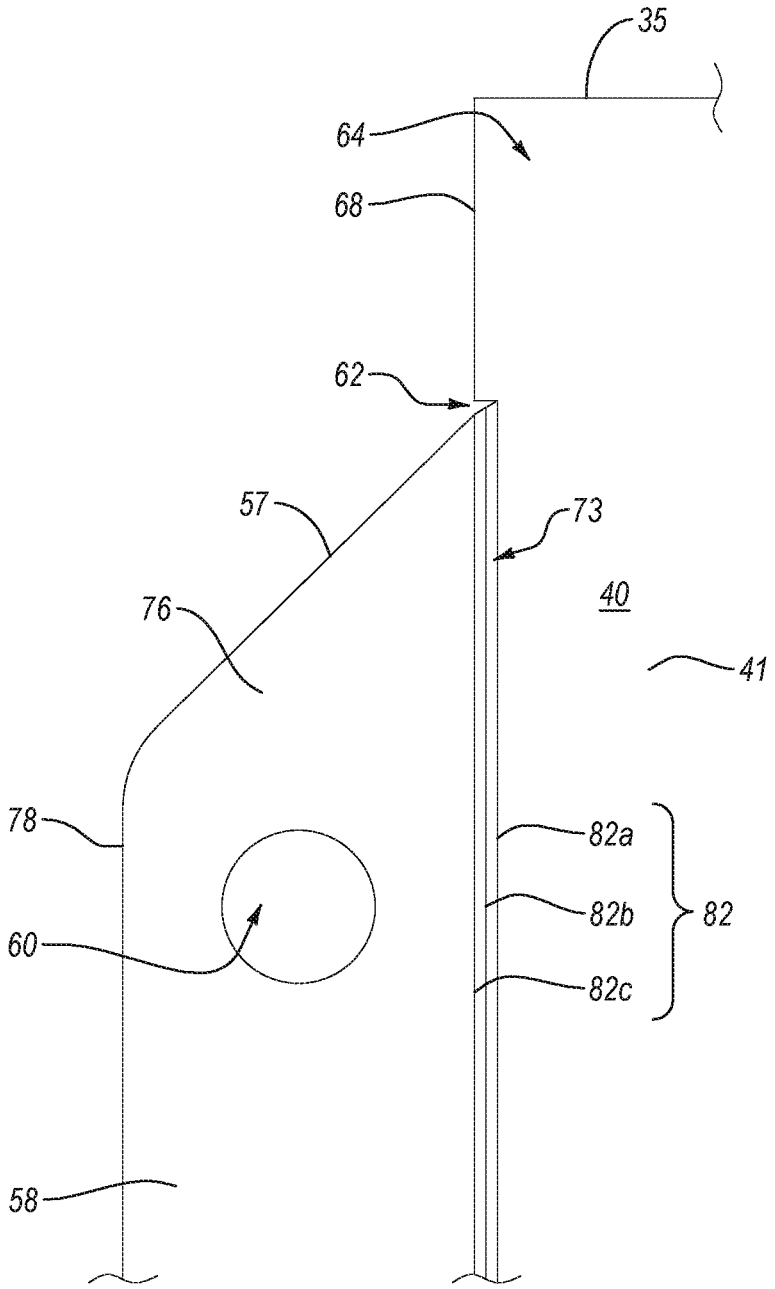
FIG. 3C illustrates a detailed view of a portion of the panel of FIG. 3A.

FIGS. 3A-3C depict an illustrative panel 40 in a substantially flat, un-curved, and/or unbent configuration (see FIG.

3B). As depicted in FIG. 3A, panel 40 comprises an upper edge 35, a lower edge 33, and opposing flanges 58 extending from opposing sides thereof. Flange 58 can include optional opening(s) 60 extending therethrough. Panel 40 also includes opposing upper edge portions 64 and opposing lower edge portions 66. Upper edge 35 can extend through (to the (terminal) end of) upper edge portions 64 and lower edge 33 can extend through (to the (terminal) end of) lower edge portions 66. Opposing notches 62 can be disposed, respectively, between flange 58 and upper edge portions 64, and between flange 58 and lower edge portions 66.

As depicted in the detailed view illustrated in FIG. 3C, notch 62 can comprise an optionally triangular-shaped cut or slit adapted to provide a gap or separation between at least a portion of (e.g., side edge 68) upper edge portion 64 and at least a portion of (e.g., body portion 76 and/or edge portion 73) of flange 58. As described above, notch 62 can extend inward (toward body 41 of panel 40) from edge 68 a length of less than about 10 mm, 9 mm, 8 mm, 7 mm, 6 mm, 5 mm, 4 mm, 3 mm, 2 mm, or 1 mm. Alternatively, notch 62 can extend inward from edge 68 a length of less than about 5%, 4%, 3%, 2%, 1%, 0.5%, or 0.25% the width of flange 58 (or the distance flange 58 extends away from edge 68).

Flange 58 also includes recessed top edge 57 (e.g., extending at an angle away from upper edge 35, edge 68, upper edge portion 64, and/or notch 62). It will be appreciated that a recessed lower edge 57 can be similarly configured relative to lower situated components. In at least one implementation, the angle between recessed edge 57 of flange 58 (e.g., whether upper and/or lower situated) and edge 35, 33 can be (about) 45°. Alternatively, the angle between recessed edge 57 of flange 58 and edge 35, 33 can be greater than or less than 45° (e.g., between about 30° (or less) and about 60° (or more)). Similarly, the angle between recessed edge 57 of flange 58 and edge 68 can be (about) 135°. Alternatively, the angle between recessed edge 57 of flange 58 and edge 68 can be greater than or less than 135° (e.g., between about 120° (or less) and about 150° (or more)).

It is noted that in one or more implementations, the angle of tapered or recessed edge 57 can be chosen so as to reduce or substantially prevent shadowing on portion(s) of light fixture 12 (see FIGS. 1A-1B). For instance, the angle of recessed edge 57 can be selected to reduce or substantially prevent flange 58 from casting a shadow on one or more diffusers 34, 19 (e.g., when light fixture 12 is illuminated, such as by means of the lighting components of lighting lid 36). In certain implementations, an angle of (significantly) less than 45° between recessed edge 57 and edge 35, 33 can (potentially) cause flange 58 to cast a shadow on one or more diffusers 34, 19 when light fixture 12 is illuminated by means of the lighting components of lighting lid 36.

Moreover, the angle of recessed edge 57 can be selected to maintaining sufficient flange material at the tapered or recessed edge portion to provide structural stability (e.g., such that the recessed portion of flange 58 does not break easily while assembling drum 30 and/or light fixture 12). For instance, in some implementations, an angle of (significantly) greater than 45° between recessed edge 57 and edge 35, 33 can (potentially) cause flange 58 to be weak or fragile adjacent to recessed edge 57. Such weak or fragile flange portions can break during manipulation, such as bending and/or assembly of drum 30 and/or light fixture 12. Thus, in at least one implementation, an optimal angle between recessed edge 57 of flange 58 (e.g., whether upper and/or lower situated) and edge 35, 33 can be (about) 45°, and an optimal angle between recessed edge 57 of flange 58 (e.g., whether upper and/or lower situated) and edge 68 can be (about) 135°.

As described above, flange 58 can be bent along edge portion 73 to form rounded edge 72 of flange 58 (see FIGS. 2C-2D). In at least one implementation, edge portion 73 of flange 58 can comprise one or more rounding elements 82. Rounding element 82 can comprise a crease, score, or perforation(s) in some implementations. In at least one implementation, rounding element 82 can comprise a thinning of panel 40 between exterior surface 54 and interior surface 56. Rounding element 82 can be adapted to reduce the force necessary to bend flange 58 relative to body portion 41, upper edge portion 64, and/or lower edge portions 66.

In the depicted embodiment, for example, edge portion 73 of flange 58 has a first rounding element 82*a* (disposed adjacent to body portion 41 of panel 40), a third rounding element 82*c* (disposed adjacent to body portion 76 of flange 58), and a second rounding element 82*b* (disposed between the first rounding element 82*a* and third rounding element 82*c*).

Figure 4A:
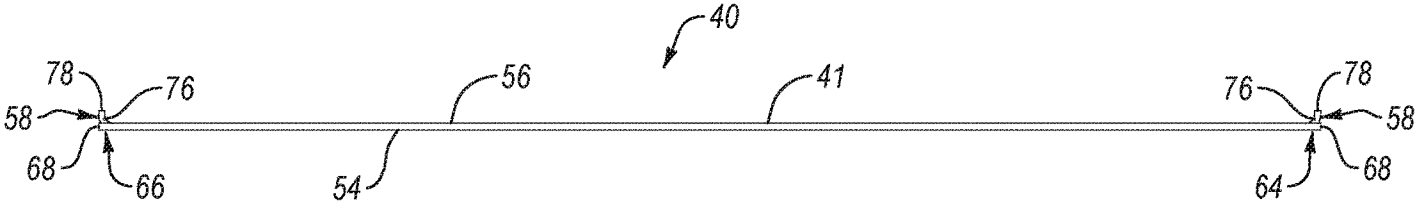
FIG. 4A illustrates a bottom plan view of a panel useful in forming a drum in accordance with still another implementation of the present disclosure.
Figure 4B:
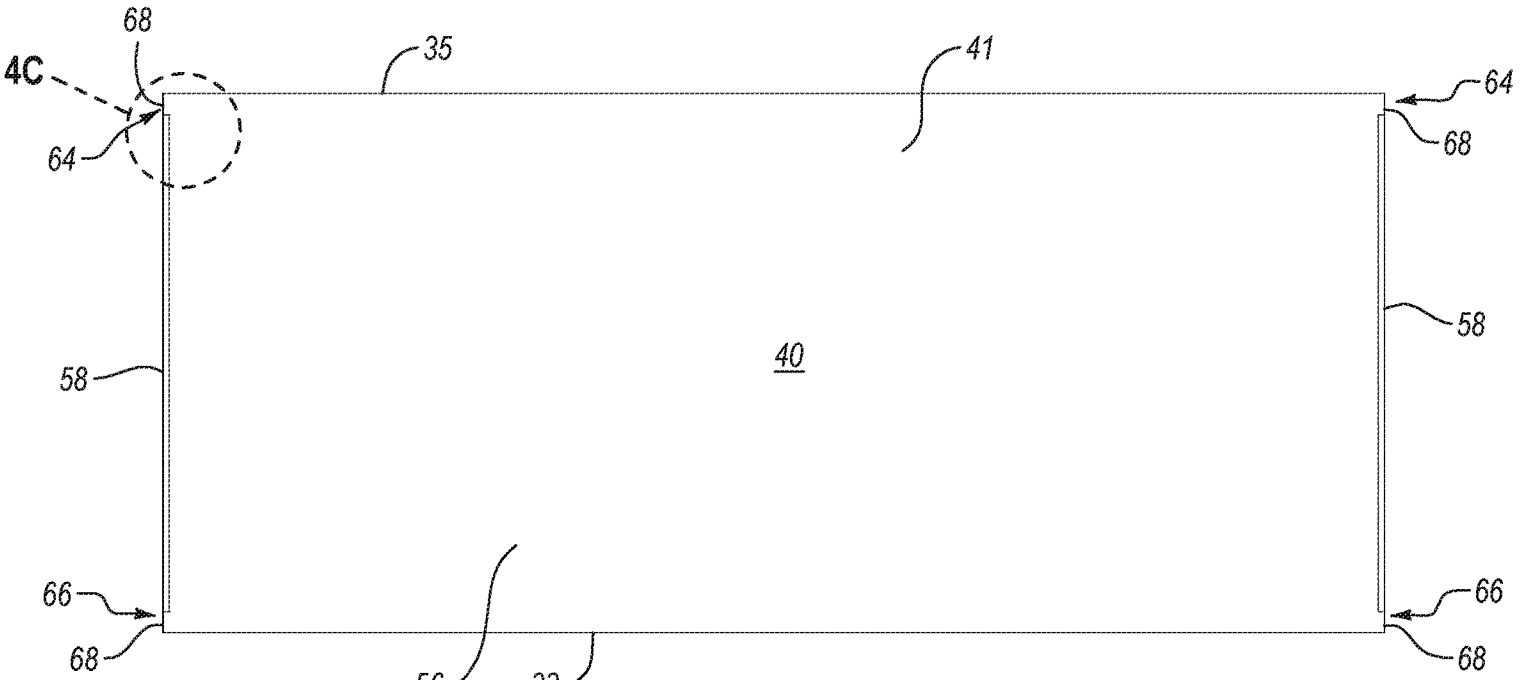
FIG. 4B illustrates a rear elevation view of the panel of FIG. 4A.
Figure 4C:
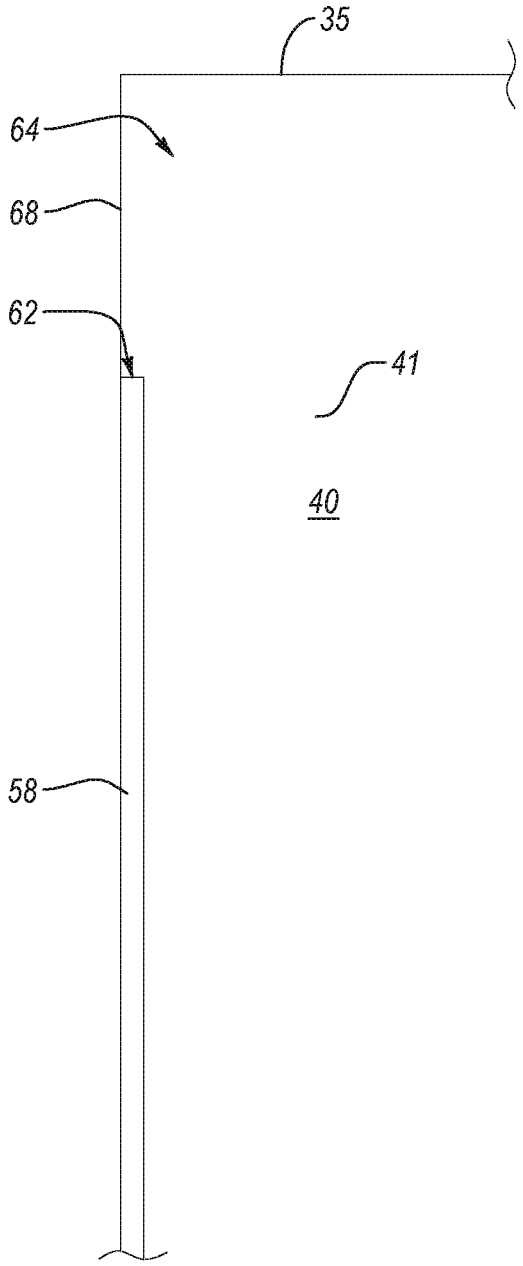
FIG. 4C illustrates a detailed view of a portion of the panel of FIG. 4B.

In some implementations, rounding element(s) 82 can extend from and/or between notch(es) 62. Accordingly, notch 62 can enable flange 58 to be bent relative to the upper edge portion 64, body portion 41, and/or lower edge portion 66 without substantially bending upper edge portion 64, body portion 41, and/or lower edge portion 66. As depicted in FIGS. 4A-4C, for instance, flange 58 can be bent such that body portion 76 of flange 58 is disposed at an angle (e.g., substantially perpendicular) relative to body portion 41, lower edge portion 66, and/or upper edge portion 64 of panel 40. In such a configuration, body portion 76 and/or edge 78 of flange 58 can be disposed and/or face a direction at an angle relative to body portion 41 and/or edge 68 of upper edge portion 64 and/or lower edge portion 66. Accordingly, notch 62 can enable lower edge portion 66 and/or upper edge portion 64 of panel 40 to retain a substantially unbent configuration while flange 58 is bent relative to body portion 41, lower edge portion 66, and/or upper edge portion 64 thereof.

As indicated above, in certain implementations, flange 58 can be bent such that body portion 76 (e.g., adjacent edge 78) is disposed at an angle of slightly less than 90° relative to the edge portions 66, 64 or slightly more than 90° relative to the inner surface 56 of panel 40. Thus, upon assembly, as in FIGS. 2A-2D, flanges 58 can be further bent to a 90°, with flanges 58 at least partially resisting or being resilient to the further bending, such that flanges 58 press against one another in the assembled drum 30. Such pressure can stabilize and/or secure opposing and/or additional joints at interfaces 80, create a tight and/or gapless butt seam 70 between joined edge portions 66, 64, and/or reduce (or substantially eliminate) light from shining, reflecting, or leaking through butt seam 70 at connection interface 80.

Figure 5A:
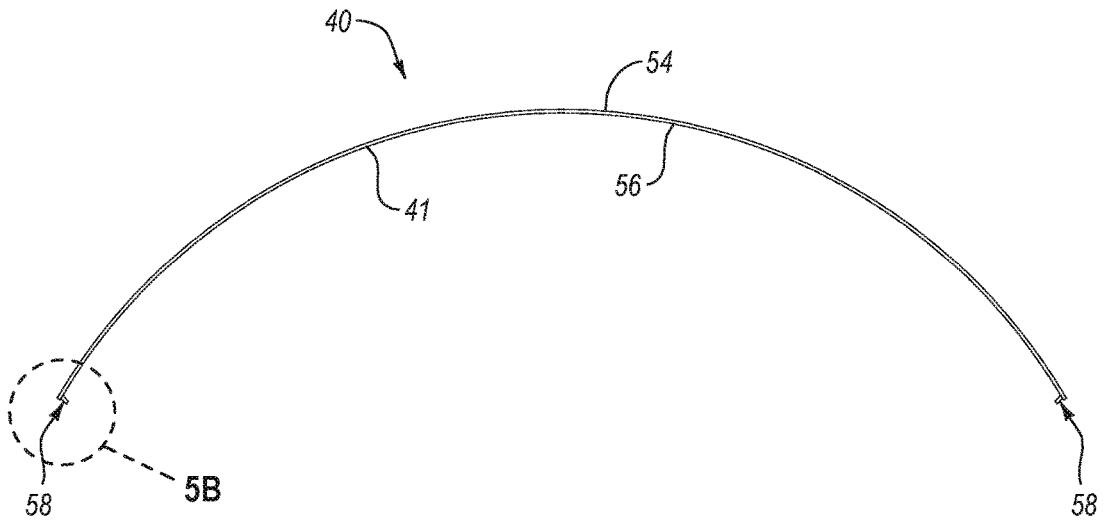
FIG. 5A illustrates a bottom plan view of a panel useful in forming a drum in accordance with yet another implementation of the present disclosure.
Figure 5B:
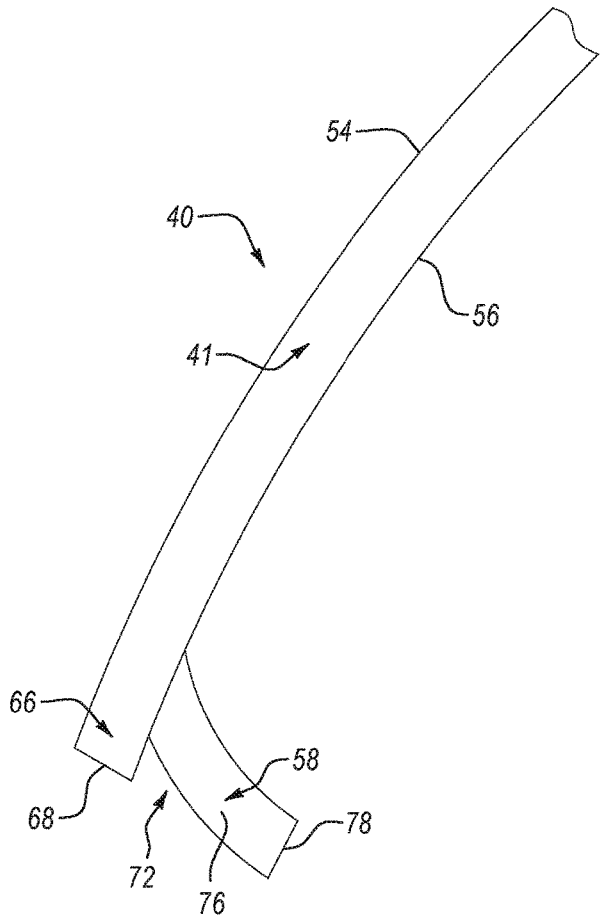
FIG. 5B illustrates a detailed view of a portion of the panel of FIG. 5A.

As depicted in FIGS. 5A-5B, panel 40 and/or body portion 41 thereof (along with upper edge portions 64 and/or lower edge portions 66) can also be bent, curved, and/or otherwise shaped (relative to the straight configuration illustrated in FIGS. 4A-4C). In the detailed view depicted in FIG. 5B, the curvature of panel 40 can extend (uniformly) through body portion 41, upper edge portions 64, and lower edge portions 66. Accordingly, from a technical standpoint, upper edge portions 64 and lower edge portions 66, along with body portion 41, can all have a curved configuration. However, as will be appreciated by those skilled in the art, flange 58 can still be bent, rounded, and/or curved relative to body portion 41, upper edge portions 64, and/or lower edge portions 66.

Moreover, bent flanges 58 can extend at least partially beyond straight edge 68 of lower edge portion 66. In the bent configuration, flanges 58 can be semi-rigid and resiliently further bendable or deformable within a certain range of motion (e.g., such that the further bent flange 58 biases and/or tends to return to the original bent position). Accordingly, in a multi-panel configuration, as depicted in FIG. 2A, joined flanges 58, further, resiliently bent to a substantially 90° angle relative to edge portion 66, 64 of panel 40 (or other portion(s) thereof, such as inner surface 56, outer surface 54, body portion 41, etc.), can be biased and/or tend to return to the original bent position (e.g., illustrated in FIG. 5B). The joined, further bent flanges 58 can produce opposing forces on one another that, when translated along the length of panels 40, press opposing joints (e.g., edge portions 64, 66 and/or flanges 58) together at an opposing interface 80 (see FIG. 2A). The force can be sufficient to press panels 40 tightly together and/or produce a tight seam 70 between the opposing edge portions, such that the butt seam 70 is substantially devoid of a perceivable gap between the blunt, terminal ends 68 of the edge portions 64, 66, thereby reducing (or substantially eliminate) light from shining, reflecting, or leaking through butt seam 70 at connection interface 80. Tucked seam 74 can also be pressed tightly together in some implementations.

Moreover, notch 62 can enable lower edge portion 66 and/or upper edge portion 64 of panel 40 to retain straight edges 68 while flange 58 presents a rounded edge 72 (at connection interface 80, see FIG. 2D). As illustrated in FIG. 2C, the straight edges 68 of upper edge portions 64 (and/or lower edge portions 66) can be joined and/or secured at the interface 80 so as to form butt seam 70. Butt seam 70 can comprise a substantially gapless joinder and/or connection between straight edges 68 of opposing upper edge portions 64 (and/or lower edge portions 66). For instance, in at least one implementation, connection between straight edges 68 of opposing upper edge portions 64 (and/or lower edge portions 66) can comprise a terminal edge and/or surface connection, such that the opposing panels and/or upper edge portions 64 (and/or lower edge portions 66) thereof terminate in a joinder at connection interface 80. Accordingly, butt seam 70 can have the appearance of a fine line opposing panels 40.

As further illustrated in FIG. 1C, butt seam 70 can provide an aesthetic appeal in light fixtures 12 and/or assemblies 10 formed thereby. In particular, when viewed from (directly) below (and/or (directly) above) the fine line butt seam 70 can provide a significant aesthetic advantage over the appearance of tuck seam 74, as the appearance of surface gap (or indent) 75 may be substantially reduced and/or eliminated thereby (see FIGS. 2A and 2C). Thus, the butt seam(s) can reduce the visibility of the tucked seam from above and/or below the light fixture 12 (e.g., when the butt seam is disposed in front of the tucked seam).

In addition, because upper edger portion 64 and/or lower edge portion 66 are disposed adjacent upper edge 35 and/or lower edge 33, respectively, upper edger portion 64 and/or lower edge portion 66 can reduce and/or eliminate visibility of at least a portion of flange 58 from above and/or below the light fixture 12 (see FIG. 2A). Likewise, edge(s) 57 of flange 58 can be angled away from upper edger portion 64 and/or lower edge portion 66, upper edge 35 and/or lower edge 33, and/or notch 62, thereby further reducing the visibility thereof and/or enhancing the aesthetic display or appeal (see FIG. 2B).

Moreover, with lower diffuser 34 connected to (e.g., secured within) a lower edge 33 of sidewall 32 (e.g., with sidewall 32 wrapped around lower diffuser 34), lower diffuser 34 can further reduce and/or eliminate visibility of at least a portion of flange 58 from below light fixture 12 (see FIG. 1C). It will be appreciated that upper diffuser 19 can perform a similar function of reducing and/or eliminating visibility of at least a portion of flange 58 from above light fixture 12 (see FIG. 1A).

In accordance with the foregoing description, an illustrative method of forming a low-profile light fixture joint can comprise joining a first end (46) of a polymeric panel (40*b*) with a second end (48) of a polymeric panel (40*c*) at a connection interface (80*b*), the first end (46) and the second end (48) each comprising an upper edge portion (64), a lower edge portion (66) opposite the upper edge portion, a flange (58) extending between the upper edge portion and the lower edge portion, and a notch (62) disposed between the flange and the lower edge portion, wherein the lower edge portion of the first end and the lower edge portion of the second end each present a straight edge (68) at the connection interface, the straight edge of the lower edge portion of the first end and the straight edge of the lower edge portion of the second end forming a butt seam (70) at the connection interface, the flange of the first end and the flange of the second end each presenting a rounded edge (72) at the connection interface, the rounded edge of the flange of the first end and the rounded edge of the flange of the second end forming a tucked seam (74) at the connection interface.

The method can also comprise a step(s) of (i) providing one or more polymeric panels having a body portion extending between a first and a second end, a first flange extending from the first end and an optional second flange extending from the second end, (ii) (thermo)forming the first end, and optionally the second end, of the polymeric panel by bending the flange thereof relative to the lower edge portion thereof, while optionally maintaining the lower edge portion in a substantially unbent configuration relative to the flange, the notch enabling the lower edge portion to retain the substantially unbent configuration relative to the flange while the flange of the first end of a polymeric panel is bent relative to the lower edge portion thereof, and/or (iii) configuring a first polymeric panel such that the first end is proximal to and joinable with the opposing second end. It will be appreciated that the first and second end can also or alternatively comprise first and second opposing ends of the same polymeric panel.

Additional description and examples related to certain aspects of the present disclosure are set forth in PCT/US2014/065816, filed 14 Nov. 2014, and published as WO 2015/073907 A3 on 21 May 2015, the entire contents of which are incorporated herein by specific reference.

Various alterations and/or modifications of the inventive features illustrated herein, and additional applications of the principles illustrated herein, which would occur to one skilled in the relevant art and having possession of this disclosure, can be made to the illustrated implementations without departing from the spirit and scope of the invention as defined by the claims, and are to be considered within the scope of this disclosure. Thus, while various aspects and implementations have been disclosed herein, other aspects and implementations are contemplated. While a number of methods and components similar or equivalent to those described herein can be used to practice implementations of the present disclosure, only certain components and methods are described herein.

It will also be appreciated that systems, processes, and/or products according to certain implementations of the present disclosure may include, incorporate, or otherwise comprise properties features (e.g., components, members, elements, parts, and/or portions) described in other implementations disclosed and/or described herein. Accordingly, the various features of certain implementations can be compatible with, combined with, included in, and/or incorporated into other implementations of the present disclosure. Thus, disclosure of certain features relative to a specific implementation of the present disclosure should not be construed as limiting application or inclusion of said features to the specific implementation. Rather, it will be appreciated that other implementations can also include said features without necessarily departing from the scope of the present disclosure. Moreover, unless a feature is described as requiring another feature in combination therewith, any feature herein may be combined with any other feature of a same or different implementation disclosed herein. Furthermore, various well-known aspects of illustrative systems, processes, products, and the like are not described herein in particular detail in order to avoid obscuring aspects of the example implementations. Such aspects are, however, also contemplated herein.

The present disclosure may be embodied in other specific forms without departing from its spirit or essential characteristics. The described implementations are to be considered in all respects only as illustrative and not restrictive. The scope of the invention is, therefore, indicated by the appended claims rather than by the foregoing description. Each of the appended claims, as well as the recited elements thereof, is intended to be combinable with any other claim(s) and/or element(s) in any suitable combination or dependency without regard to the dependency in which said claims are presented. While certain implementations and details have been included herein and in the attached disclosure for purposes of illustrating implementations of the present disclosure, it will be apparent to those skilled in the art that various changes in the methods and apparatus disclosed herein may be made without departing from the scope of the invention, which is defined in the appended claims. All changes which come within the meaning and range of equivalency of the claims are to be embraced within their scope.

What is claimed is:

1. A method of forming a low-profile light fixture joint, comprising:

providing a first end of a polymeric panel and a second end of a polymeric panel at a connection interface, the first end and the second end each comprising:

an upper edge portion;

a lower edge portion opposite the upper edge portion;

a flange extending inwardly relative to an outer surface of the polymeric panel, between the upper edge portion and the lower edge portion, wherein each flange comprises a lower tapered edge adjacent to the lower edge portion; and a notch disposed between the flange and the lower edge portion;

wherein:

the lower edge portion of the first end and the lower edge portion of the second end each present a straight edge at the connection interface;

the flange of the first end and the flange of the second end each presenting a rounded edge at the connection interface;

joining the straight edge of the lower edge portion of the first end and the straight edge of the lower edge portion of the second end to form a butt seam at the connection interface; and joining the rounded edge of the flange of the first end and the rounded edge of the flange of the second end to form a tucked seam at the connection interface.

2. The method of claim 1, wherein the first end and the second end each further comprise a notch disposed between the flange and the upper edge portion, the flange further comprising an upper tapered edge adjacent to the upper edge portion, the upper edge portion of the first end and the upper edge portion of the second end each presenting a straight edge at the connection interface and wherein the method further comprises:

joining the straight edge of the upper edge portion of the first end and the straight edge of the upper edge portion of the second end to form a butt seam at the connection interface.

3. The method of claim 1, further comprising securing the flange of the first end and the flange of the second end together by means of one or more fasteners.

4. The method of claim 3, wherein securing the flanges together by means of the one or more fasteners is sufficient to maintain contact between the straight edge of the lower edge portion of the first end and the straight edge of the lower edge portion of the second end at the connection interface.

5. The method of claim 1, further comprising forming the first end of a polymeric panel by bending the flange thereof relative to the lower edge portion thereof, the notch enabling the flange to be bent relative to the lower edge portion without substantially bending the lower edge portion.

6. The method of claim 1, wherein the first end comprises a first end of a first polymeric panel and the second end comprises a second end of the first polymeric panel opposite the first end thereof, the first polymeric panel having a configuration that brings the first end into proximity with the second end such that the first end is joinable with the second end.

7. The method of claim 6, further comprising configuring the first polymeric panel such that the first end is proximal to and joinable with the opposing second end.

8. The method of claim 1, wherein the first end comprises a first end of a first polymeric panel and the second end comprises a second end of a second polymeric panel.

9. A low-profile light fixture joint, comprising:

a first end of a polymeric panel joined with a second end of a polymeric panel at a connection interface, the first end and the second end each comprising:

an upper edge portion;

a lower edge portion opposite the upper edge portion;

a flange extending inwardly between the upper edge portion and the lower edge portion, wherein each flange comprises a lower tapered edge adjacent to the lower edge portion; and a notch disposed between the lower tapered edge of the flange and the lower edge portion;

wherein:

the lower edge portion of the first end and the lower edge portion of the second end each present a straight edge at the connection interface;

the straight edge of the lower edge portion of the first end and the straight edge of the lower edge portion of the second end forming a butt seam at the connection interface;

the flange of the first end and the flange of the second end each presenting a rounded edge at the connection interface; and the rounded edge of the flange of the first end and the rounded edge of the flange of the second end forming a tucked seam at the connection interface.

10. The light fixture joint of claim 9, wherein each flange further comprises an upper tapered edge adjacent to the upper edge portion and the first end and the second end each further comprise a notch disposed between the upper tapered edge of the flange and the upper edge portion, the upper edge portion of the first end and the upper edge portion of the second end each presenting a straight edge at the connection interface, the straight edge of the upper edge portion of the first end and the straight edge of the upper edge portion of the second end forming a butt seam at the connection interface.

11. The light fixture joint of claim 9, further comprising one or more fasteners securing the flange of the first end and the flange of the second end together at the connection interface so as to maintain contact between the straight edge of the lower edge portion of the first end and the straight edge of the lower edge portion of the second end at the connection interface.

12. The light fixture joint of claim 9, wherein the first end comprises a first end of a first polymeric panel and the second end comprises a second end of the first polymeric panel opposite the first end thereof, the first polymeric panel having a configuration that brings the first end into proximity with the second end such that the first end is joinable with the second end.

13. The light fixture joint of claim 9, wherein the first end comprises a first end of a first polymeric panel and the second end comprises a second end of a second polymeric panel.

14. The light fixture joint of claim 9, wherein the respective notches enable the respective lower edge portions to retain the respective straight edges at the connection interface while the respective flanges present the respective rounded edges at the connection interface.

15. A light fixture, comprising:

a drum having an encircling sidewall comprising one or more polymeric panels, a first end of the one or more polymeric panels being joined with a second end of the one or more polymeric panels at a connection interface, the first end and the second end each comprising:

an upper edge portion;

a lower edge portion opposite the upper edge portion;

a flange extending inwardly between the upper edge portion and the lower edge portion, the flange having a lower tapered edge adjacent to the lower edge portion; and a notch disposed between the lower tapered edge of the flange and the lower edge portion;

wherein:

the lower edge portion of the first end and the lower edge portion of the second end each present a straight edge at the connection interface;

the straight edge of the lower edge portion of the first end and the straight edge of the lower edge portion of the second end forming a butt seam at the connection interface;

the flange of the first end and the flange of the second end each presenting a rounded edge at the connection interface; and the rounded edge of the flange of the first end and the rounded edge of the flange of the second end forming a tucked seam at the connection interface.

16. The light fixture of claim 15, wherein each flange further comprises an upper tapered edge adjacent to the upper edge portion and the first end and the second end each further comprise a notch disposed between the upper tapered edge of the flange and the upper edge portion, the upper edge portion of the first end and the upper edge portion of the second end each presenting a straight edge at the connection interface, the straight edge of the upper edge portion of the first end and the straight edge of the upper edge portion of the second end forming a butt seam at the connection interface.

17. The light fixture of claim 15, further comprising one or more fasteners securing the flange of the first end and the flange of the second end together at the connection interface so as to maintain contact between the straight edge of the lower edge portion of the first end and the straight edge of the lower edge portion of the second end at the connection interface.

18. The light fixture of claim 15, wherein the first end comprises a first end of a first polymeric panel and the second end comprises a second end of the first polymeric panel opposite the first end thereof, the first polymeric panel having a configuration that brings the first end into proximity with the second end such that the first end is joinable with the second end.

19. The light fixture of claim 15, wherein the first end comprises a first end of a first polymeric panel and the second end comprises a second end of a second polymeric panel.

20. The light fixture of claim 15, wherein the respective notches enable the respective lower edge portions to retain the respective straight edges at the connection interface while the respective flanges present the respective rounded edges at the connection interface.

* * * * *